United States Patent [19]

Skinner

[11] Patent Number: 4,547,198

[45] Date of Patent: Oct. 15, 1985

[54] METHOD FOR DISCHARGING TREATED COAL AND CONTROLLING EMISSIONS FROM A HEAVY OIL SPRAY SYSTEM

[75] Inventor: James L. Skinner, Tucson, Ariz.

[73] Assignee: Atlantic Richfield Company, Los Angeles, Calif.

[21] Appl. No.: 594,652

[22] Filed: Mar. 29, 1984

[51] Int. Cl.[4] ..... C10L 5/24; C10L 5/22

[52] U.S. Cl. ..... 44/1 R; 44/6; 44/1 G; 110/267

[58] Field of Search ..... 44/1 G, 6, 1 R; 208/23; 34/12, 22, 61; 110/218, 245, 267, 268, 271

[56] References Cited

U.S. PATENT DOCUMENTS

| | | | |
|---|---|---|---|
| 1,832,459 | 11/1931 | Hanim | 110/271 |
| 2,261,540 | 11/1941 | Coder | 110/267 X |
| 3,985,516 | 10/1976 | Johnson et al. | 44/6 X |
| 3,985,517 | 10/1976 | Johnson | 44/6 X |
| 4,201,657 | 6/1980 | Anderson et al. | 44/6 X |
| 4,331,445 | 5/1982 | Burns | 44/6 |
| 4,396,394 | 8/1983 | Li et al. | 44/1 R |
| 4,396,395 | 8/1983 | Skinner et al. | 44/6 |
| 4,402,706 | 9/1983 | Wunderlich | 44/1 G |
| 4,402,707 | 9/1983 | Wunderlich | 44/6 |
| 4,421,520 | 12/1983 | Matthews | 44/6 |

*Primary Examiner*—D. E. Gantz
*Assistant Examiner*—Glenn A. Caldarola
*Attorney, Agent, or Firm*—F. Lindsey Scott

[57] ABSTRACT

A method for discharging heavy oil treated particulate coal and controlling emissions from a heavy oil spray contacting vessel is disclosed. In particular, a bed of heavy oil treated coal is maintained in the lower portion of the oil spray contacting vessel. The heavy oil treated coal is withdrawn from the bottom of the bed while maintaining the bed at a sufficient depth to remove a major portion of the heavy oil mist from gaseous materials within the vessel. A major portion of gaseous materials are made to pass downwardly through the bed.

6 Claims, 4 Drawing Figures

METHOD FOR DISCHARGING TREATED COAL AND CONTROLLING EMISSIONS FROM A HEAVY OIL SPRAY SYSTEM

This invention to methods and apparatus for treating particulate coal with heavy oil.

This invention further relates to methods and apparatus for controlling the emission of heavy oil from apparatus for treating particulate coal with heavy oil.

In recent years, there has been considerable interest in the mining and use of low rank coal. Brown coal, lignite and sub-bituminous coals are generally considered to be lower rank coals with anthracite and bituminous coals being considered higher rank coals. While there has been considerable interest in the mining and use of the lower rank coals as fuels because of their relatively low mining costs and because many of the lower rank coals have a relatively low sulfur and ash content, the use of such lower rank coals as a fuel has been greatly inhibited by the fact that as produced they typically contain a relatively high percentage of water. As a result, various processes have been developed to dry such lower rank coals to produce coal having a lower water content for use as a fuel. U.S. Pat. No. 4,354,825 issued Oct. 19, 1982 to Fisher, et. al. and U.S. Pat. No. 4,396,394 issued Aug. 2, 1983 to Li, et. al. disclose two such processes and are hereby incorporated in their entirety by reference.

The dried coal produced by such processes frequently had a tendency to undergo spontaneous ignition and combustion in storage or in transit. Such dried low rank coals also frequently tend to generate large quantities of dust upon handling. Heavy oil compositions have been used to reduce the tendency of such dried low rank coal to spontaneously ignite and in some instances in an attempt to control the dusting tendencies of the dried low rank coal. Some such heavy oil compositions are shown in U.S. Pat. No. 4,201,657 issued May 6, 1980 to Anderson, et. al. and U.S. Pat. No. 4,402,707 issued Sept. 6, 1983 to Wunderlich, both of which are hereby incorporated in their entirety by reference.

In the treatment of such dried low rank coal with heavy oil, intimate contact between the heavy oil and the particulate coal is necessary to insure that uniform treatment of the particulate coal with the heavy oil is accomplished. Since the heavy oil may be viscous or solid at room temperature, the accomplishment of intimate contact between the particulate coal and the heavy oil requires suitable apparatus. One such apparatus is disclosed in U.S. Pat. No. 4,396,395 issued Aug. 2, 1983 to Skinner, et. al., which is hereby incorporated in its entirety by reference. The disclosed apparatus has been found to be effective in the treatment of particulate coal with heavy oil.

In the treatment of particulate coal with heavy oil, it has been found that in many instances it is necessary to use air or some other carrier gas to assist in dispersing the heavy oil via spray systems to produce a mist of the heavy oil in a mist chamber or mist zone through which the particulate coal falls. The apparatus disclosed in U.S. Pat. No. 4,396,395 has been found effective for accomplishing intimate contact of heavy oil and particulate coal.

In the treatment and handling of particulate coal and heavy oil in such systems, environmental considerations are a continuing concern. In particular, it is highly undesirable that finely divided coal, i.e. coal dust, be allowed to escape from the apparatus or that the heavy oil mist be allowed to escape from the apparatus and into the atmosphere. As a result, continuing efforts have been directed to the development of improved apparatus for treating particulate coal with heavy oil while insuring that the emission of coal, coal dust or heavy oil to the atmosphere is minimized.

It is now been found that heavy oil-treated particulate coal is readily discharged from a contacting vessel for treating such particulate coal with heavy oil while controlling emissions from the contacting vessel by an apparatus comprising:

(a) a discharge chute positioned to receive the heavy oil treated coal from the lower end of the contacting vessel and discharge the heavy oil-treated coal from a discharge chute outlet positioned on the lower end of the discharge chute;

(b) a conveyor belt means positioned at a selected distance beneath the discharge chute outlet so that when the conveyor belt is stopped, a bed of said heavy oil-treated coal is retained in the discharge chute and so that when the conveyor belt is activated controlled quantities of the heavy oil-treated coal are discharged through the discharge chute outlet at a rate such that a bed of heavy oil-treated coal is retained in the discharge chute; and, (c) a drive means for driving the conveyor belt at a selected rate.

In the use of the apparatus, a bed of heavy oil-treated particulate coal is maintained in the lower portion of the contacting vessel so that air or other gaseous materials exhausted from the contacting vessel pass downwardly through the bed of heavy oil-treated coal so that at least a major portion of the heavy oil mist contained in the exhausted gaseous materials is removed by retention in the bed. The exhausted gaseous material may be further cleaned prior to discharging the gaseous material into the atmosphere.

In the discussion of the Figures, the same numbers will be used throughout to refer to the same or similar components.

Figure 1:
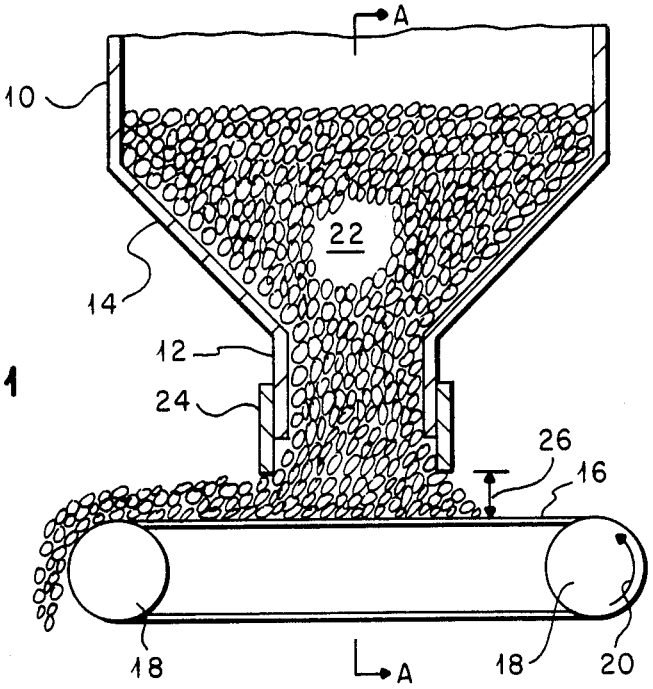
FIG. 1 is a schematic diagram of an embodiment of the apparatus of the present invention.

In FIG. 1, a contacting vessel 10 (oil spray chamber) including a discharge chute 12 positioned on the lower portion 14 of contacting vessel 10 is shown. Discharge chute 12 includes on its lower end an adjustable extension 24, which extends about the perimeter of discharge chute 12. Extension 24 is desirably slideably mounted on discharge chute 12. A conveyor belt 16 supported by rollers 18 is positioned beneath discharge chute 12 at a spacing 26 such that the angle of repose of the treated coal prevents the treated coal from flowing from discharge chute 12 when conveyor belt 16 is stopped. As well known to those skilled in the art, particulate coal has a characteristic angle of repose which basically defines the steepest angle at which the particulate coal can be maintained in a stack or pile without restraint. Belt 16 is of a length and of a width such that treated particulate coal will not flow from discharge chute 12 when belt 16 is stopped. A bed 22 of coal is maintained in lower portion 14 of contacting vessel 10 as shown. When it is desired to remove treated coal from vessel 10, conveyor belt 16 is started and coal is removed as shown in FIG. 1. Spacing 26 may be adjusted by movement of extension 24 as desired. In the operation of the apparatus conveyor belt 16 is operated at a variable speed. The operation of such conveyor belts and means for driving and controlling the speed of such conveyor belts is considered to be well known to those skilled in the art. The rate of removal of treated coal product on belt 16 is adjusted to maintain bed 22 at a selected depth. In other words, the removal of treated coal is coordinated with the charging of dried low rank coal to vessel 10 for treatment so that the bed depth remains relatively constant. Since in many instances air or other gaseous materials may be used as carriers or atomizing aids in spraying heavy oil into vessel 10 by sprays (not shown) a considerable amount of gas must be exhausted from vessel 10. This gaseous material typically contains entrained heavy oil since a heavy oil mist is maintained in vessel 10. It is undesirable that this dispersed heavy oil be lost since it constitutes a valuable treating material and it is even more undesirable that it be emitted to the atmosphere. Accordingly, the gaseous material is exhausted through bed 22 so that a major portion of the dispersed heavy oil is retained in bed 22 as the gaseous material discharges downwardly through bed 22.

Figure 2:
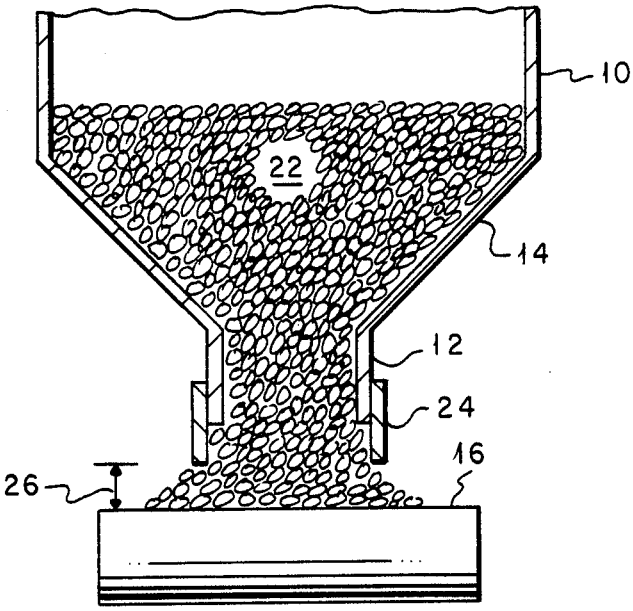
FIG. 2 is a schematic diagram of the apparatus of FIG. 1 taken at line AA.

In FIG. 2, a sectional view of the apparatus of FIG. 1 is shown and indicates the width of conveyor belt 16. As indicated previously, conveyor belt 16 should be of a width such that when operating at spacing 26 the angle of repose of the heavy oil-treated coal is such that the coal is retained on conveyor 16. In many instances sufficient quantities of the heavy oil may be removed in bed 22 so that no further treatment of the emitted gaseous material is necessary.

Discharge chute 12 and conveyor belt 16 should be sized so that when operating at a desired spacing 26 the flow of gaseous material through bed 22 is at a rate low enough so that finely divided coal is not blown off belt 16 and into the atmosphere. Desirably a relatively low pressure drop exists across bed 22.

Figure 3:
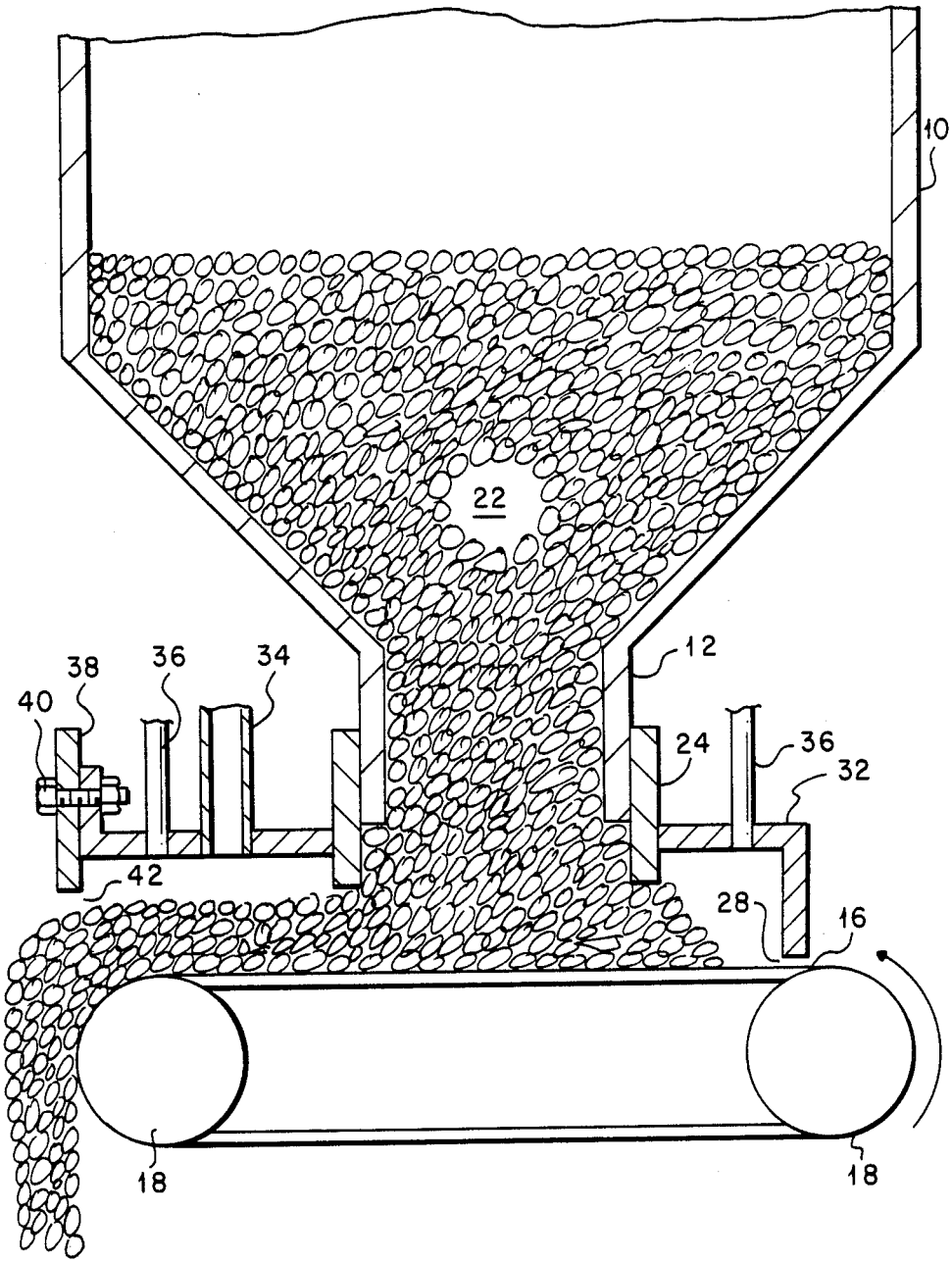
FIG. 3 is a schematic diagram of a further embodiment of the apparatus of the present invention; and, FIG. 4 is a schematic diagram of a gas clean up system for use in conjunction with apparatus such as shown in FIG. 3.

In FIG. 3, a further embodiment of the apparatus of the present invention is shown. A hood 32 is positioned over conveyor belt 16 so that the gaseous material exhausted from vessel 10 through bed 22 can be collected and passed to further treatment through a line 34. Line 34 is in fluid communication with a blower or other means for producing suction so that a negative pressure can be maintained beneath hood 32. Hood 32 may be supported as shown on extension 24 or by supports 36 as shown. Supports 36 may be connected to any suitable support and desirably include means for adjusting the height of hood 32. Hood 32 is desirably positioned to have a relatively close clearance 28 with belt 16 or a suitably close clearance 42 with the surface of the treated coal removed on belt 16. Clearance 42 may be separately adjusted by means of a plate 38 and adjustment means shown as a bolt 40 in FIG. 3. Alternatively, hood 32 may be of a fixed shape adapted to maintain the desired clearance with belt 16 and with the discharged coal without additional adjustment.

Figure 4:
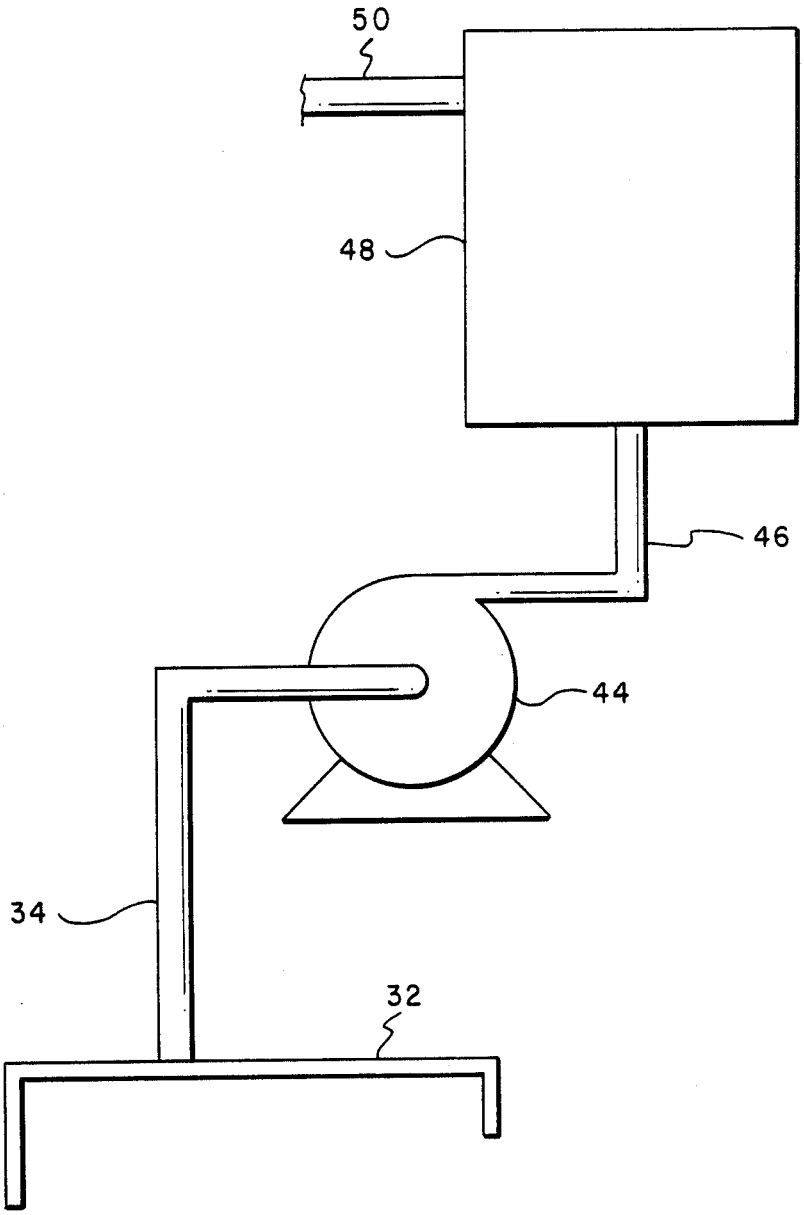

FIG. 4 is a schematic diagram of a gas clean up system for use with hood 32. Line 34 extends from hood 32 to a blower 44, which as indicated previously is used to maintain a negative pressure under hood 32. The exhausted gases are then passed on through a line 46 to a gas clean up system 48 from which cleaned gases are discharged through a line 50 to the atmosphere. Methods for removing solid particulate materials and heavy oil materials from gaseous streams are well known to those skilled in the art and a variety of such methods can be used.

In the practice of the present invention, dried low rank coal is charged to a contacting vessel such as that shown in U.S. Pat. No. 4,396,395 for treatment with heavy oil. The heavy oil treatment is accomplished as the particulate coal falls through a heavy oil mist zone. The materials discharged from the process are a gaseous stream generated at least in part by the use of atomizing or dispersing air in the heavy oil spray system and the heavy oil-treated particulate coal. By the method of the present invention, a bed of the treated particulate coal is retained in the bottom of contacting vessel 10 so that the exhaust gases from vessel 10 flow through the bed of coal as they exhaust. The bed of treated coal acts as a filter with quantities of the heavy oil mist being deposited on the particulate coal in bed 22 as exhaust gases leave vessel 10. As a result, bed 22 is subjected to a further coating action by a mist of heavy oil descending upon the top surface of bed 22 as gaseous materials are exhausted from vessel 10. In conjunction with this desirable coating of additional heavy oil onto the particulate coal, the exhausting gases are effectively filtered to remove heavy oil mist from the exhaust gases. As a result, at least two highly desirable benefits are achieved, i.e. the additional coating of heavy oil onto the particulate coal and the filtration of the exhausting gaseous materials.

When coal is sprayed with a heavy oil, air atomizing nozzles are frequently required in order to obtain good atomization of the oil. The amount of atomizing air required can be considerable, ranging up to 200 Standard Cubic Feet of air per gallon of oil sprayed. If the coal is discharged from spray chamber 10 through an open (unsealed) outlet the atomizing air can be vented to the atmosphere through the coal discharge outlet. In practice, this can lead to heavy loss of oil droplets carried from spray chamber 10 with two undesirable consequences. These are a decrease in oil spray efficiency and release of oil droplets, or mist, into the atmosphere, thus polluting the air.

Such oil loss to the atmosphere can be circumvented by providing a seal on the coal outlet and thus forcing the atomizing air to discharge through a bed 22 of sprayed coal. As the atomizing air passes through coal bed 22, the coal particles trap the contained oil droplets and thus act as an oil droplet filter or "demister". The bottom discharge seal is usually provided by installing a screw feeder, "star feeder" (rotary valve) or some other solids handling device at the discharge of spray chamber 10. Since direct control over the solids handling device can be exercised by controlling the speed of the drive motor to the device, a bed of coal can be established at the bottom of spray chamber 10 where it can trap oil droplets. However, when air atomizing nozzles are employed in spray chamber 10, the interstitial area (area between particles, etc.) available for air flow through the coal in the screw feeder, rotary valve, etc. may be insufficient to allow venting of the atomizing air without the buildup of of a large differential pressure within spray chamber 10. If a pressure is built up in spray chamber 10, it can result in "backflow" of atomizing air (and contained droplets) up through the feed system to spray chamber 10 with attendant discharge of oil droplets or mist "out the other end", or jamming of the coal feed system due to pressure build-up downstream.

The method and apparatus of this invention permits the discharge of the atomizing air through a bed of treated coal without an attendant pressure build up in spray chamber 10. The apparatus shown in the Figures permits filtration of the exhaust air by coal bed 22 without excessive build up of pressure in spray chamber 10. Discharge chute 12 is designed with a cross-sectional area sufficient to allow the flow of atomizing air from contacting vessel 10, with minimal pressure drop, through bed 22 in discharge chute 12. The distance between the bottom of discharge chute 12 (or adjustment extension 24) and belt 16 is made large enough so that the cross-sectional area available for flow of the atomizing air is sufficient to keep the exit air velocity low as it exits coal bed 22 along the sides, back and front. The cross-sectional area of concern is the perimeter of discharge chute 12 (or extension 24) multiplied by the distance between the bottom of chute 12 (or extension 24) and the top of conveyor belt 16. There must be sufficient cross-sectional area to keep the air velocity low enough to prevent "blowing of coal" off conveyor belt 16. Typically, air velocities of 1 or 2 ft per second should prevent blowing coal off conveyor belt 16. An adjustable extension allows for optimum geometrys over a wide range of coal and oil rates. The bed depth in the bottom of spray chamber 10 can be controlled by varying the speed of conveyor belt 16 under discharge chute 10. Conveyor belt 10 should be wide enough to allow for the angle of repose of the discharged coal to prevent coal from spilling over the sides.

Desirably bed 22 is of a depth sufficient to remove at least a major portion of the dispersed heavy oil from the gaseous material but not sufficient to create a substantial pressure drop across the bed. In other words, it is desirable that vessel 10 operate at substantially atmospheric pressure. As indicated previously, discharge chute 12 should be sized so that the gas velocity through bed 22 in chute 12 is not sufficiently high to result in blowing coal off conveyor belt 16. The desired flow rate may vary substantially dependent upon the particular coal to be treated, the amount of fines contained in the particulate coal and the like. In many instances, it may be found that even at relatively low discharge velocities a small cloud of heavy oil, finely divided coal or mixtures thereof exists in the vicinity of discharge chute 12. In some instances, it may be found that the materials which escape from the surfaces of the treated coal on belt 16 are in fact oil coated finely divided coal particles. Such particles may behave as dust when the particles are very fine and may be recovered by use of hood 32. In such instances, it is desirable that hood 32 or similar equipment be used and that a slight negative pressure be maintained beneath hood 32.

When atomizing or dispersing gas is used to aid in finely dispersing the heavy oil, any suitable gas may be used. Air is preferred, but other gases may be used especially if explosion hazards exist. The effectiveness of the present invention is not dependent upon the particular gas selected.

Having thus described the invention by reference to its preferred embodiments, it is pointed out that the embodiments described are illustrative rather than limiting in nature and that many variations and modifications are possible within the scope of the present invention. Many such variations and modifications may appear obvious and desirable to those skilled in the art based upon a review of the foregoing description of preferred embodiments.

Having thus described the invention, I claim:

1. In a method for intimately contacting a dried low rank coal with a heavy oil to reduce the tendency of said dried coal to spontaneously ignite, said method consisting essentially of:

(a) charging said coal to a heavy oil mist zone in a contacting vessel so that said coal falls through said mist zone;

(b) injecting finely dispersed droplets of said heavy oil and an atomizing gas into said contacting vessel to maintain a mist of said heavy oil in said mist zone;

(c) intimately contacting said coal and said mist to absorb a sufficient quantity of said heavy oil onto said coal to produce a heavy oil-treated coal as said coal falls through said mist zone; and, (d) recovering said heavy oil-treated coal; an improvement comprising:

(e) maintaining a bed of said heavy oil treated coal in the lower portion of said contacting vessel;

(f) recovering said heavy oil-treated coal by withdrawing said heavy oil-treated coal from the bottom of said bed;

(g) maintaining said bed at a depth sufficient to remove at least a major portion of said heavy oil mist from gaseous materials, said gaseous materials comprising said atomizing gas discharged from said contacting vessel through said bed; and, (h) passing at least a major portion of said gaseous materials from said contacting vessel downwardly through said bed.

2. The improvement of claim 1 wherein substantially all of said gaseous materials are exhausted from said contacting vessel downwardly through said bed.

3. The improvement of claim 1 wherein at least a major portion of said gaseous materials exhausted from contacting vessel are collected and cleaned after passing through said bed.

4. A method for intimately contacting a dried low rank coal with a heavy oil to reduce the tendency of said dried coal to spontaneously ignite, said method consisting essentially of:

(a) charging said coal to a heavy oil mist zone in a contacting vessel so that said coal falls through said mist zone;

(b) maintaining a mist of said heavy oil in said mist zone;

(c) intimately contacting said coal and said mist to absorb a sufficient quantity of said heavy oil onto said coal to produce a heavy oil-treated coal as said coal falls through said mist zone;

(d) maintaining a bed of said heavy oil-treated coal in the lower portion of said contacting vessel;

(e) maintaining said bed at a depth sufficient to remove at least a major portion of said heavy oil mist from gaseous materials discharged from said contacting vessel through said bed, (f) recovering said heavy oil-treated coal by withdrawing said heavy oil-treated coal from the bottom of said bed; and, (g) passing at least a major portion of said gaseous materials from said contacting vessel downwardly through said bed.

5. The method of claim 4 wherein substantially all of said gaseous materials are passed from said contacting vessel downwardly through said bed.

6. The method of claim 4 wherein at least a major portion of said gaseous materials are collected and cleaned after passing through said bed.

* * * * *